US008932081B2

(12) United States Patent
Kamarauskas et al.

(10) Patent No.: US 8,932,081 B2
(45) Date of Patent: Jan. 13, 2015

(54) CONNECTOR WITH TERMINAL RETENTION

(75) Inventors: Michael R. Kamarauskas, Bartlett, IL (US); Shantha Kumar Sambhandam Palani, Singapore (SG); Chui Ngor Wong, Singapore (SG); Fook Onn Chong, Singapore (SG); Ser-Kiat Toh, Singapore (SG)

(73) Assignee: Molex Incorporated, Lisle, IL (US)

( * ) Notice: Subject to any disclaimer, the term of this patent is extended or adjusted under 35 U.S.C. 154(b) by 393 days.

(21) Appl. No.: 13/379,487

(22) PCT Filed: Jul. 1, 2009

(86) PCT No.: PCT/US2009/049383

§ 371 (c)(1), (2), (4) Date: May 21, 2012

(87) PCT Pub. No.: WO2011/002458

PCT Pub. Date: Jan. 6, 2011

(65) Prior Publication Data

US 2012/0225583 A1 Sep. 6, 2012

(51) Int. Cl.

| | |
|---|---|
| ***H01R 13/648*** | (2006.01) |
| ***H01R 13/41*** | (2006.01) |
| *H01R 12/57* | (2011.01) |
| *H01R 13/04* | (2006.01) |
| *H01R 12/50* | (2011.01) |
| *H01R 12/71* | (2011.01) |

(52) U.S. Cl.

CPC ..... *H01R 13/41* (2013.01); *H01R 12/57* (2013.01); *H01R 13/04* (2013.01); *H01R 23/6873* (2013.01); *H01R 12/714* (2013.01)

USPC ..... 439/607.35

(58) Field of Classification Search

CPC ..... H01R 13/41; H01R 12/57; H01R 13/04; H01R 23/6873; H01R 12/714

USPC ..... 439/607.01, 607.35, 607.36, 607.4

See application file for complete search history.

(56) References Cited

U.S. PATENT DOCUMENTS

| | | | |
|---|---|---|---|
| 5,116,263 | A | 5/1992 | Bennett et al. |
| 5,221,212 | A | 6/1993 | Davis |
| 6,024,608 | A | 2/2000 | Azuma et al. |

(Continued)

FOREIGN PATENT DOCUMENTS

| | | | |
|---|---|---|---|
| CN | 201112967 | Y | 9/2008 |
| JP | 03-94782 | U | 9/1991 |

(Continued)

OTHER PUBLICATIONS

International Search Report for PCT/US2009/049383.

*Primary Examiner* — Khiem Nguyen

(74) *Attorney, Agent, or Firm* — Stephen L. Sheldon

(57) ABSTRACT

A connector includes a shield that supports a housing. The housing includes a tongue that extends in a mating region defined by the shield. The tongue includes grooves (which may be on both sides of the shield) that support a plurality of terminals. The grooves each include a retention feature that secures the terminal in the groove while allowing a mating terminal to engage the terminals in the grooves without first engage the tongue.

20 Claims, 12 Drawing Sheets

(56) References Cited

U.S. PATENT DOCUMENTS

| | | | |
|---|---|---|---|
| 6,299,487 | B1 | 10/2001 | Lopata et al. |
| 6,935,870 | B2 | 8/2005 | Kato et al. |
| 7,044,752 | B2 | 5/2006 | Olson et al. |
| 7,104,843 | B2 | 9/2006 | Olson et al. |
| 7,238,048 | B2 | 7/2007 | Olson et al. |
| 2006/0040557 | A1 | 2/2006 | Yamaguchi |

FOREIGN PATENT DOCUMENTS

| | | |
|---|---|---|
| JP | 06-196225 A | 7/1994 |
| JP | 09-035800 | 2/1997 |
| JP | 10-106668 A | 4/1998 |

CONNECTOR WITH TERMINAL RETENTION

RELATED APPLICATIONS

This is a national phase of PCT Application No.: PCT/US2009/49383, filed Jul. 1, 2009, which is incorporated herein by reference in its entirely.

BACKGROUND OF THE INVENTION

1. Field of the Invention

The present invention generally relates to a board mounted electrical connector, more specifically to a connector with a configuration similar to that found in connectors used for a High-Definition Multimedia Interface (HDMI) standard or a DisplayPort standard.

2. Description of Related Art

As is known, I/O connectors face competing demands. On the one hand, there is a common desire to provide more dense packing of terminals. On the other hand, there is an increasing desire for the data channels in the I/O connector to function at higher frequencies. These competing desires make it challenging to optimize a connector.

While the general desires are challenging, certain configurations of connectors need to be particularly dense because they are intended to be very small. For example, when the density of terminals is increased so that that the pitch between terminals is reduced below 0.7 mm pitch, for example, the design of the connector becomes challenging and as the pitch is reduced below 0.6 mm, certain methods of mounting the connector (such as the use of thru-holes) becomes more difficult because the vias cannot be positioned close enough. Thus, for very small pitch connectors such as connectors with a 0.4 mm pitch between terminals, surface mount technology basically becomes required. Even with surface mount technology, however, it is difficult to provide a desirable signal transmission between the mating interface and the mounting interface because the proximity of the terminals makes it easy for energy moving through terminals to negatively affect the signals on other terminals (e.g., introduce unwanted noise). Furthermore, the size of the terminals makes it more difficult to provide a robust connector design that is suitable for use in designs where a relatively high number of insertion cycles are desired. Therefore, further improvements in the design of a connector would be appreciated.

BRIEF SUMMARY OF THE INVENTION

A connector is provided that includes a tongue with two opposing sides. The tongue includes a plurality of grooves in one of the sides that have a retention feature near a mating end of the tongue. A terminal is positioned in the grooves and includes a tip with a base portion and a leg portion, the base portion having a first width that is greater than a second width of the leg portion. The tip engages the retention feature and the engagement secures the terminal on the corresponding side. In an embodiment, the grooves can be positioned on both sides of the tongue in a pattern that allows a triangular alignment between a pair of signal terminals and a ground terminal. In an embodiment, the grooves and terminals can be configured so that they are on a 0.4 mm pitch. The connector may be configured for use with a HDMI standard.

BRIEF DESCRIPTION OF THE DRAWINGS

The present invention is illustrated by way of example and not limited in the accompanying figures in which like reference numerals indicate similar elements and in which.

DETAILED DESCRIPTION OF THE INVENTION

The detailed description that follows describes exemplary embodiments and is not intended to be limited to the expressly disclosed combination(s). Therefore, unless otherwise noted, features disclosed herein may be combined together to form additional combinations that were not otherwise shown for purposes of brevity.

Figure 1:
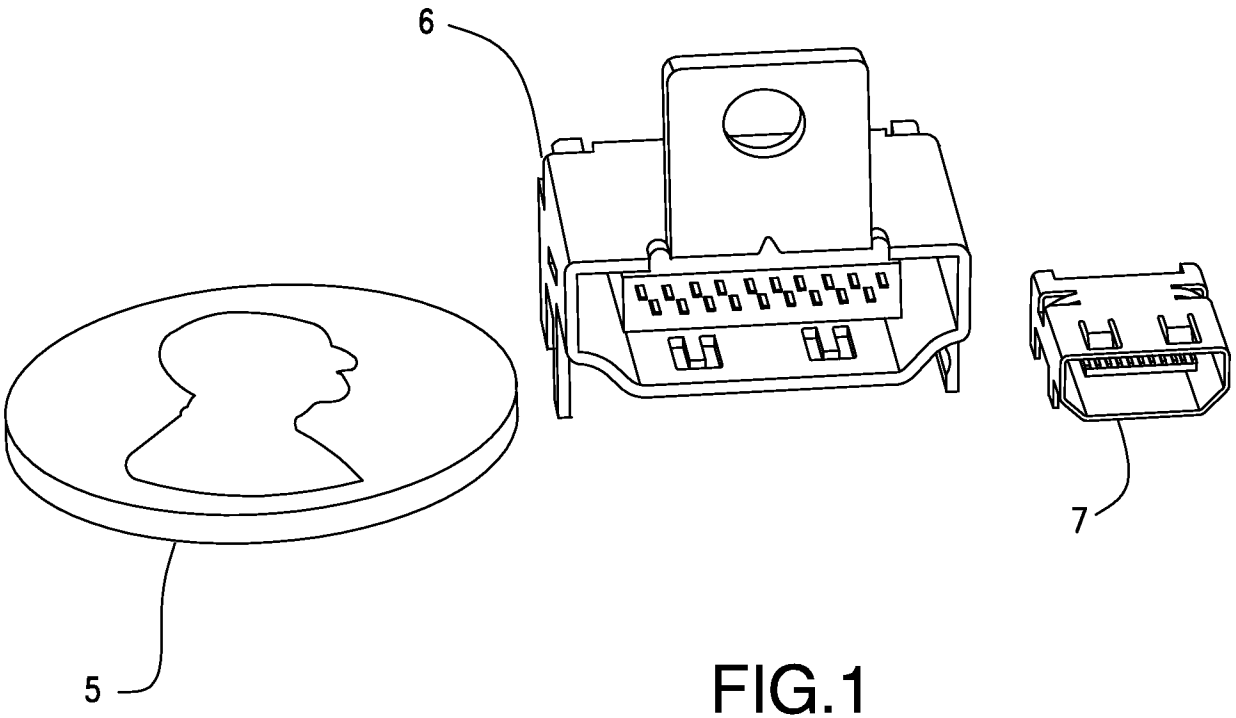
FIG. 1 illustrates the scale of connectors that can be provided based on the disclosure provided herein.
Figure 2:
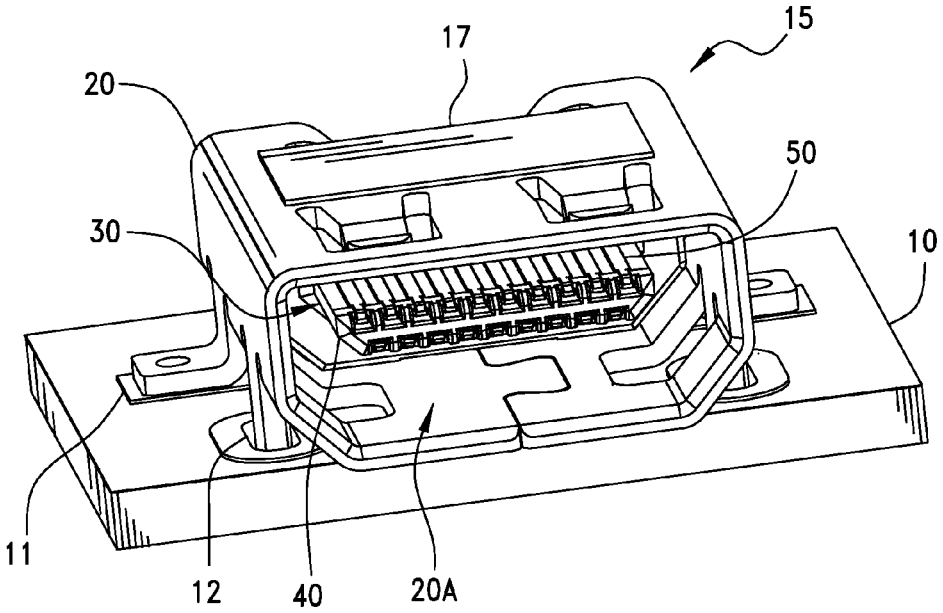
FIG. 2 illustrates a perspective view of an embodiment of a board mounted connector.
Figure 3:
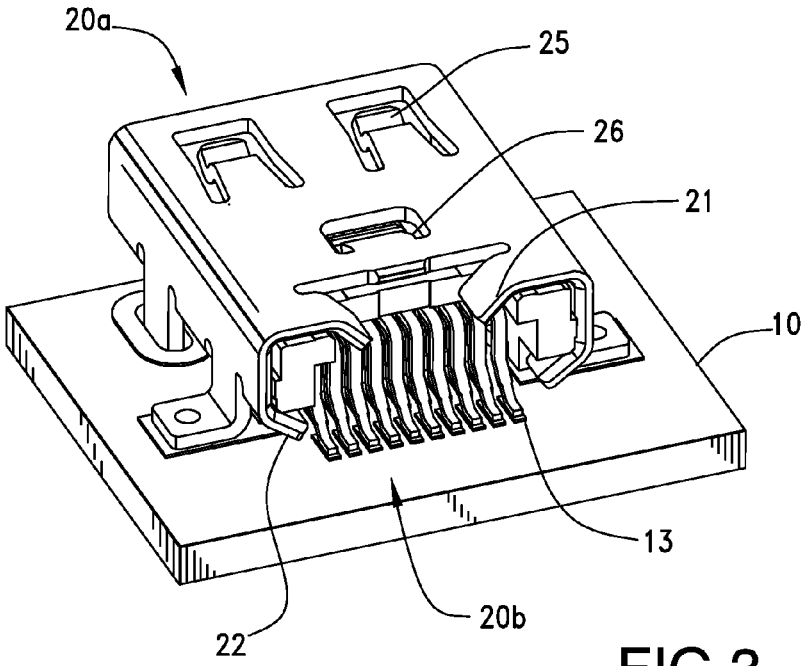
FIG. 3 illustrates another perspective view of the connector depicted in FIG. 1.
Figure 4:
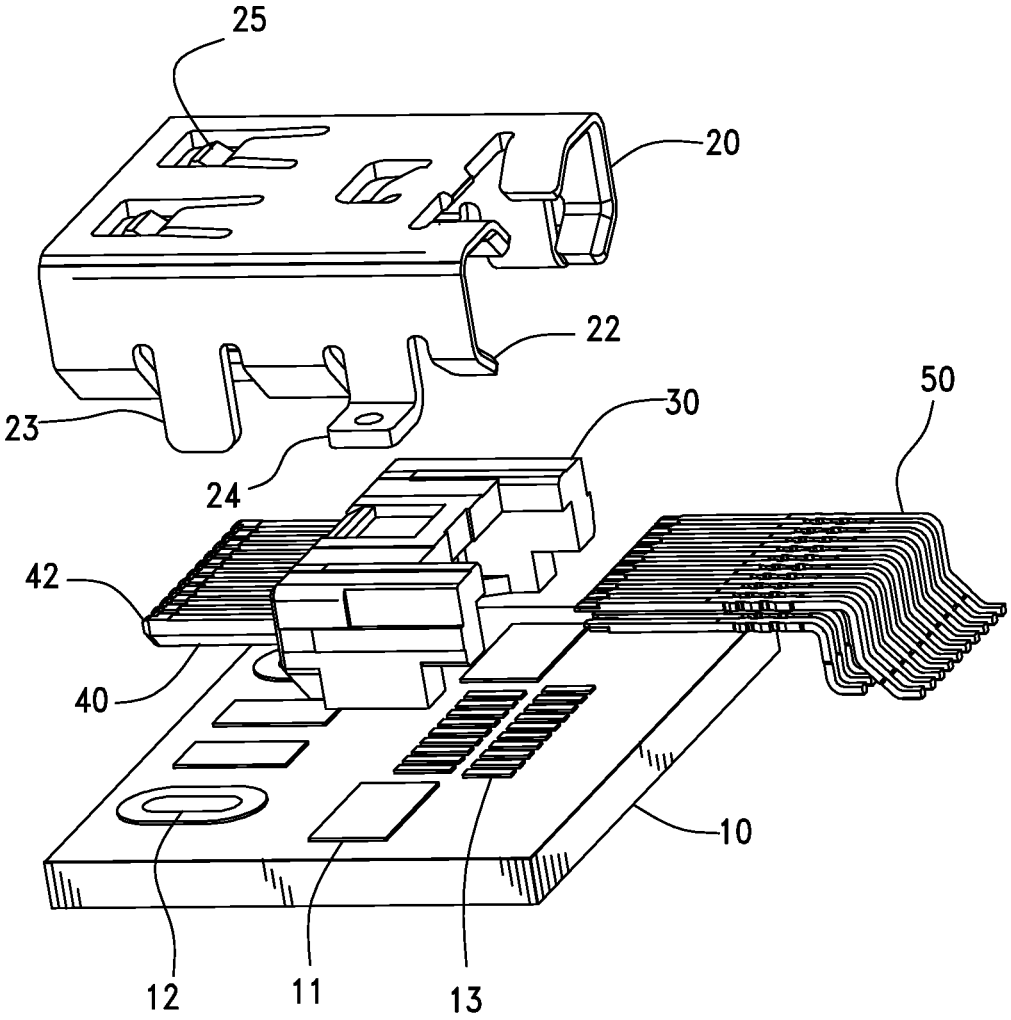
FIG. 4 illustrates a perspective, partially exploded view of the connector depicted in FIG. 1.
Figure 6:
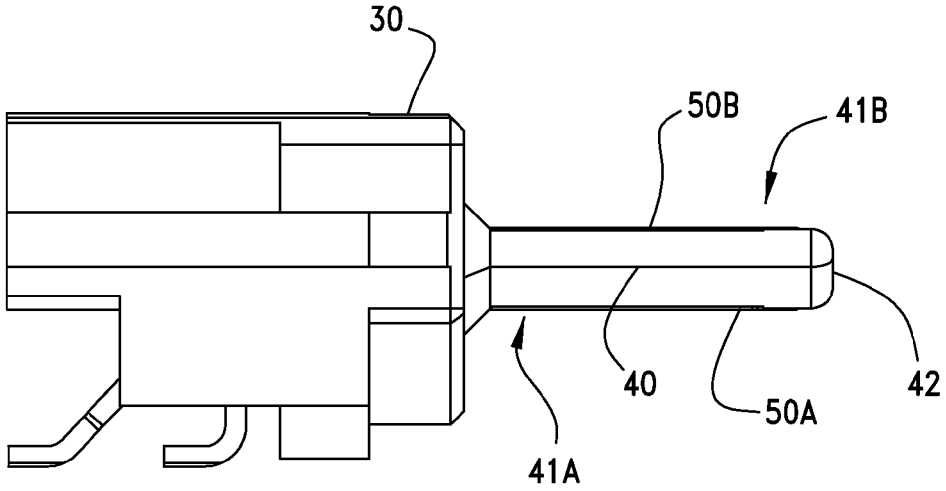
FIG. 6 illustrates an elevated side view of an embodiment of a connector housing and terminals.

FIG. 1 illustrates a penny 5 next to a typical-sized connector 6, which is next to a micro connector 7. While the typical-sized connector is relatively small, the micro connector 7 is much smaller and introduces challenges that did not previously exist. One particular challenge is that it is desirable that the micro connector be fully compatible with the conventional connector while being a fraction of the size. As can be appreciated, this introduces significant challenges because if there are 19 or 20 terminals in the typically-sized connector, the terminals must be much smaller and closer together in the micro-sized connector. It should be noted that while the features disclosed herein are beneficial for use with the micro-sized connector, a number of the features disclosed herein can also be used in the typically-sized connector. It should also be noted that while the connectors depicted herein are suitable for use with HDMI or DisplayPort type systems, this disclosure is not so limited but instead has broader application to desirable connectors with an appropriate configuration.

Turning to FIGS. 2-11, an exemplary embodiment of a connector 15 is depicted mounted on a circuit board 10, which includes mounting pads 11 and mounting apertures 12. The connector 15 includes a shield 20 that supports a housing 30 and the shield 20 includes a mating region 20*a* where a tongue 40 is positioned. A member 17 (which may be tape) may be positioned on the shield 20 as illustrated to help provide a surface for use in providing a connector compatible with a pick and place operation. To secure the housing 30, the shield 20 includes tabs 21, 22 and 26 that help hold the housing in position and provide a measure of strain relief for forces exerted on the tongue 40 or housing 30.

Terminals 50 are positioned on the tongue 40 in grooves 44 and the terminals 50 extend toward a mating end 42 of the tongue 40. The tongue 40 has a first side 41A and a second side 41B and a first row of terminals 50A is position in grooves on the first side 41A and a second row of terminals 50B is position in grooves 44 on the second side 41B. It should be noted that in an embodiment, as can be appreciated from FIGS. 6 and 8, the first and second row of terminals 50A, 50B, while positioned in the grooves 44, extend above their respective sides 41A, 41B of the tongue 40.

Figure 5:
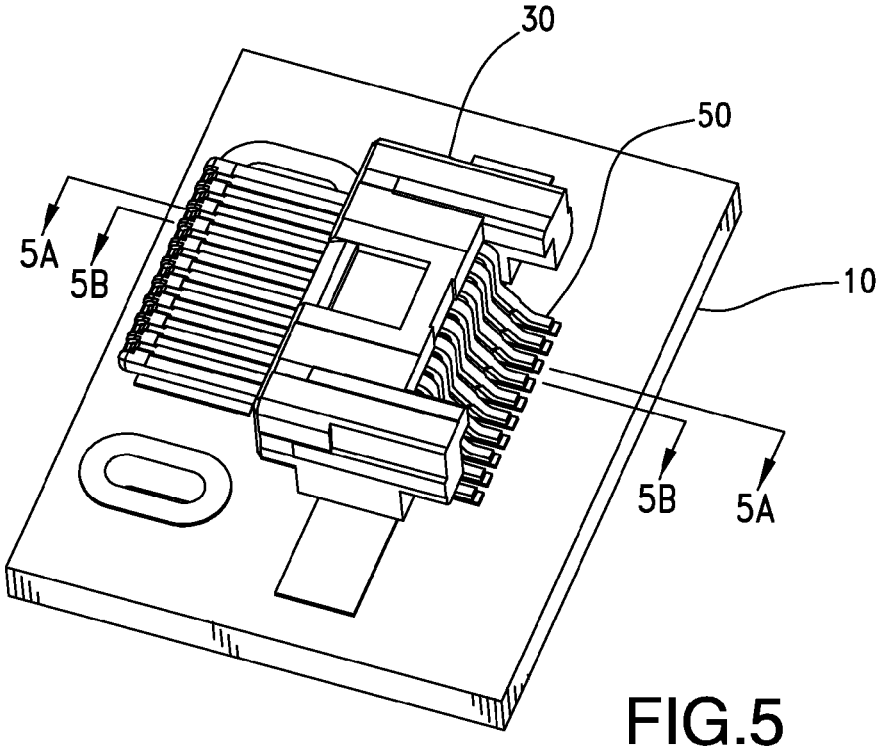
FIG. 5 illustrates a partial perspective view of the connector depicted in FIG. 1 with a shield removed.
Figure 5A:
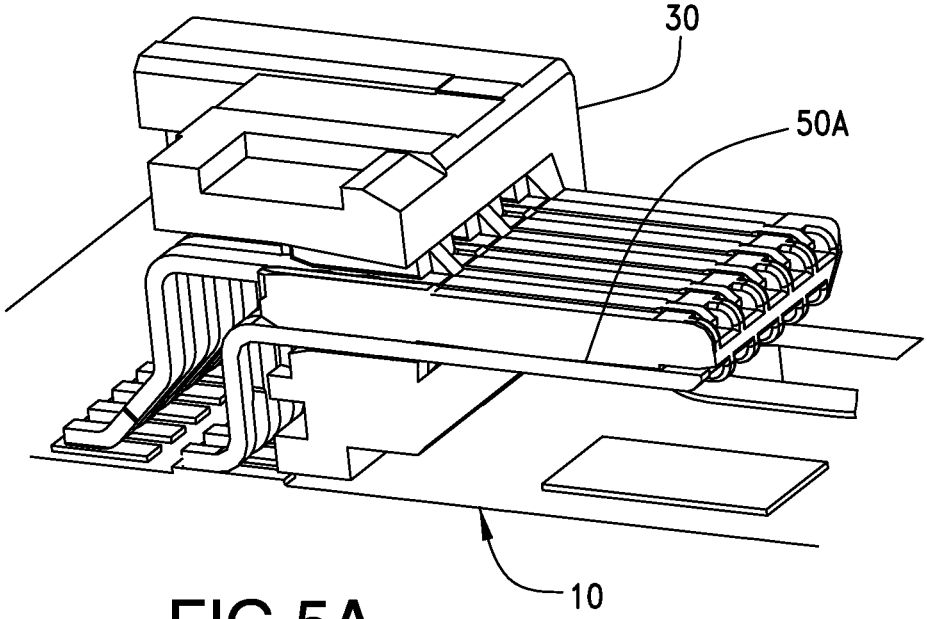
FIG. 5A illustrates a perspective cross-section view of an embodiment of a connector taken along the line 5A-5A in FIG. 5.
Figure 5B:
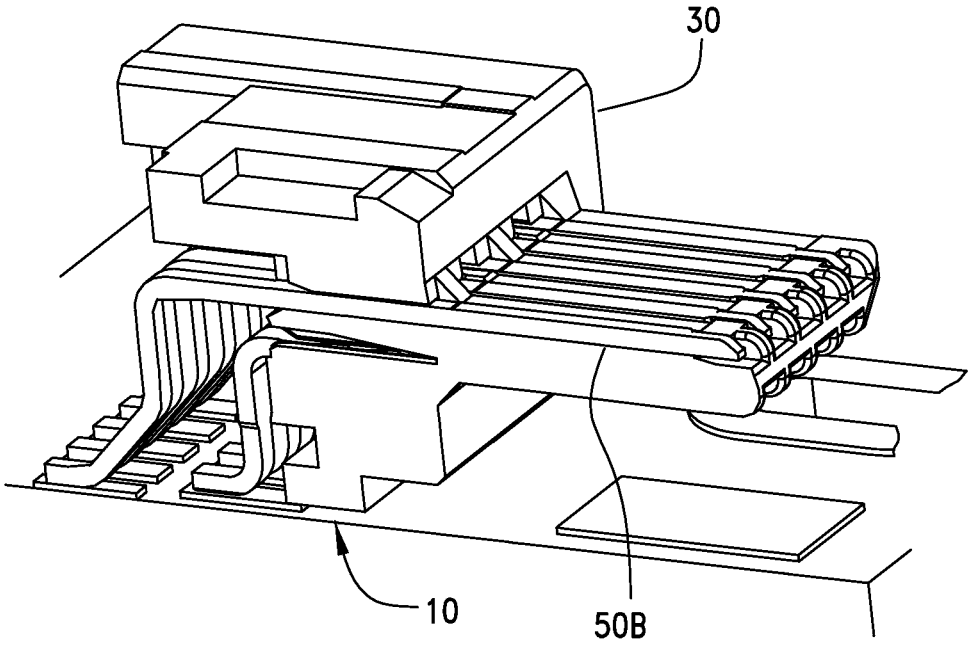
FIG. 5B illustrates a perspective cross-section view of an embodiment of a connector taken along the line 5B-5B in FIG. 5.

The terminal 50 include mating portions 51, mounting portion 52 and body portions 53 that extend between the mating portion 51 and mounting portion 52. The mounting portions 52 can be configured so that the pitch between the terminals 50 in the tongue 40 is maintained when mounting the terminals to terminal pads 13 on the circuit board 10. In such a case the first row 50A and the second row 50B can be mounted to the circuit board 10 in two rows. As can be appreciated from FIG. 9, this allows a triangular relationship between two terminals on one side of the tongue 40 and one terminal on the other side of the tongue 40 to be maintained from the mating portion through to the mounting portion, which has benefits from an electrical perspective. This also allows the overall width of the connector be kept smaller. It should be noted that the triangular relationship between terminals can alternate between triangles with a first orientation and triangles with a second orientation that about 180 degrees different from the first orientation. As depicted in from FIGS. 5A and 5B, the terminals 50 and grooves 44 are offset between the two sides of the tongue 40 so that the terminals 50 alternate between the first and second side 41A, 41B of the tongue 40. In an embodiment, the pitch between terminals on both the first and second side can be 0.4 mm with the first row of terminal 50A on the first side 41A shifted 0.2 mm compared to the second row of terminals 50B on the second side 41B.

The mating portion 51 of each terminal includes an end 54 that includes a first tip portion (e.g., a base) 55 with a width x (which in an embodiment can be about 0.2 mm) and a second tip portion (e.g., a leg) 56 with a width y (which in an embodiment can be about 0.12 mm), the second portion 56 extending from the first portion 55. A step 57 can be provided between the base 55 and the leg 56 so as to provide an abrupt transition between the width x and the width y, the width y being less than the width x. The terminal also has a height H1 (which may be about 0.15 mm) and can include an inclined surface 58 so as to assist intermateability with a corresponding mating terminal. It should be noted that as depicted, the first and second tip portion are positioned approximate the end but the tip portions could also be positioned further away from the end 54.

Figure 7:
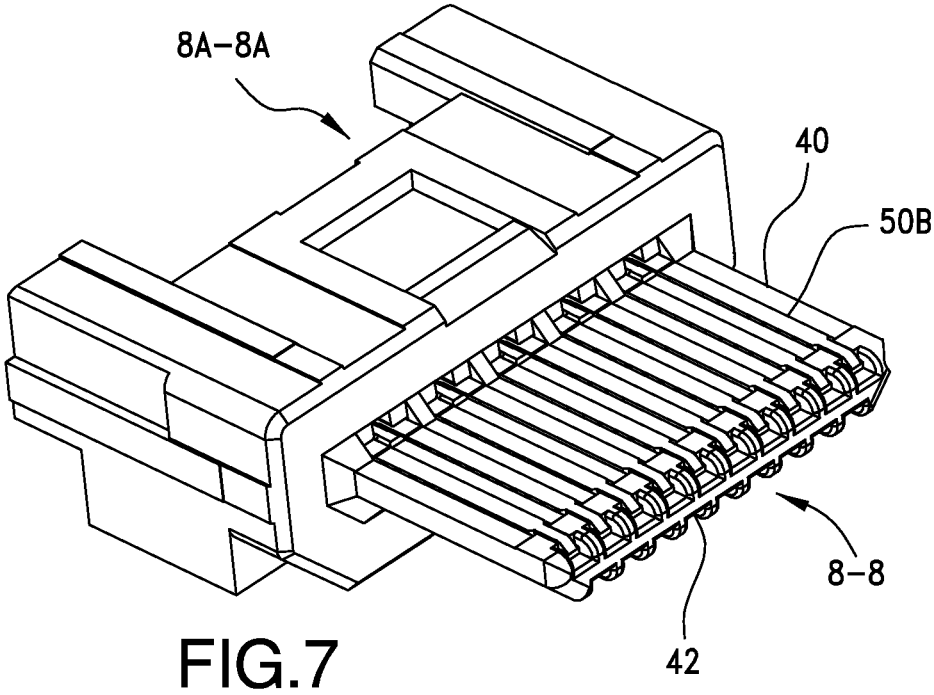
FIG. 7 illustrates a perspective view of an embodiment of a housing tongue supporting terminals.

As depicted in FIG. 7, the terminals 50 are positioned in grooves that extend toward the mating end 42 and have a height H2 (which may be about 0.13 mm) but the grooves do not extend all the way to the mating end and the terminals do not extend all the way to end of the grooves. The step 57 engages a retention feature which is depicted as a ramp 47. As depicted, the retention feature 45 includes opposing ramps 47 that cause the groove 44 to neck down at a top 43 of the groove 44 so as to provide a width z (which in an embodiment may be about 0.15 mm) to hold the terminal 50 in position. Thus, for certain embodiments, the relationship x>z>y holds true. As can be appreciated, the width of the bottom of the groove is at least equal to (and usually slightly larger) the width x (in an embodiment, the groove width may be about 0.23 mm). This allows the end 54 of the terminal 50 to be secured without positioning it under a lip of plastic that occludes the metal surface (as is common if the end of the terminal is to be secured). Furthermore, the inclined surface 58 of the terminal 50 also allows a mating terminal to engage the terminal 50 without first engaging the tongue 40 (which is typically formed of a plastic) and thus reduces the chance of causing contamination from being wiped from the tongue to the terminals (thus increasing the reliability of the connection between two mating terminals and between two mating connectors). This is particularly beneficial for smaller terminals such as terminals configured to be position on a 0.4 mm pitch as a relatively small particle would be sufficient to substantially interfere with an electrical connection between two mating terminals that are about 0.2 mm wide.

To further enhance mateability of the terminal 50, the groove can have a recess 48 at the end that causes the groove 44 to be extend away from the terminal 50 so that the end 54 is cantilevered. The recess 48 allows the terminal 50 to be slightly deflected by the ramp 47, which can help secure the terminal 50 in the groove 44. To help further secure the terminal 50 in the channel, the terminal 50 may include ribs 53*a* in the body portion 53 that are pressed into securing area 49 in the groove 44 and the securing area 49 can be configured to restrain the body 53 on four sides.

Figure 8:
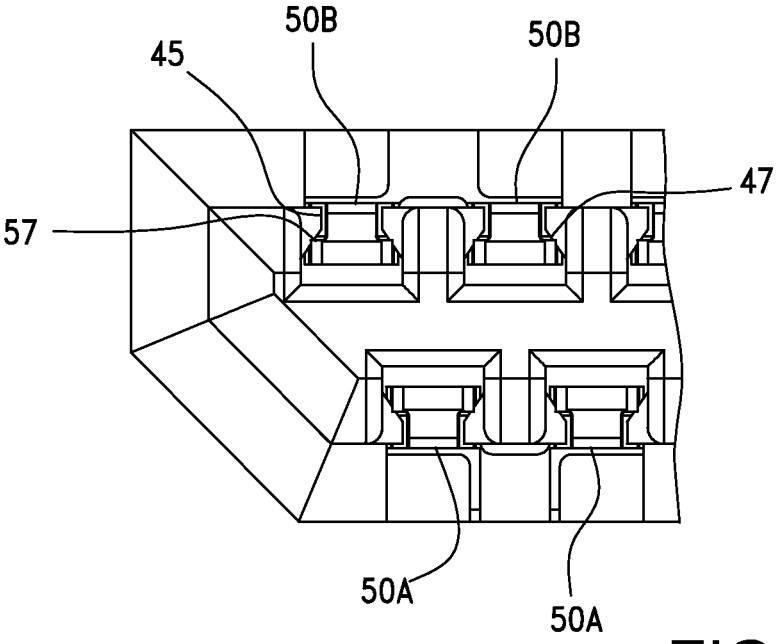
FIG. 8 illustrates an enlarged front view of the tongue and terminals depicted in FIG. 7 along the line 8-8.
Figure 8A:
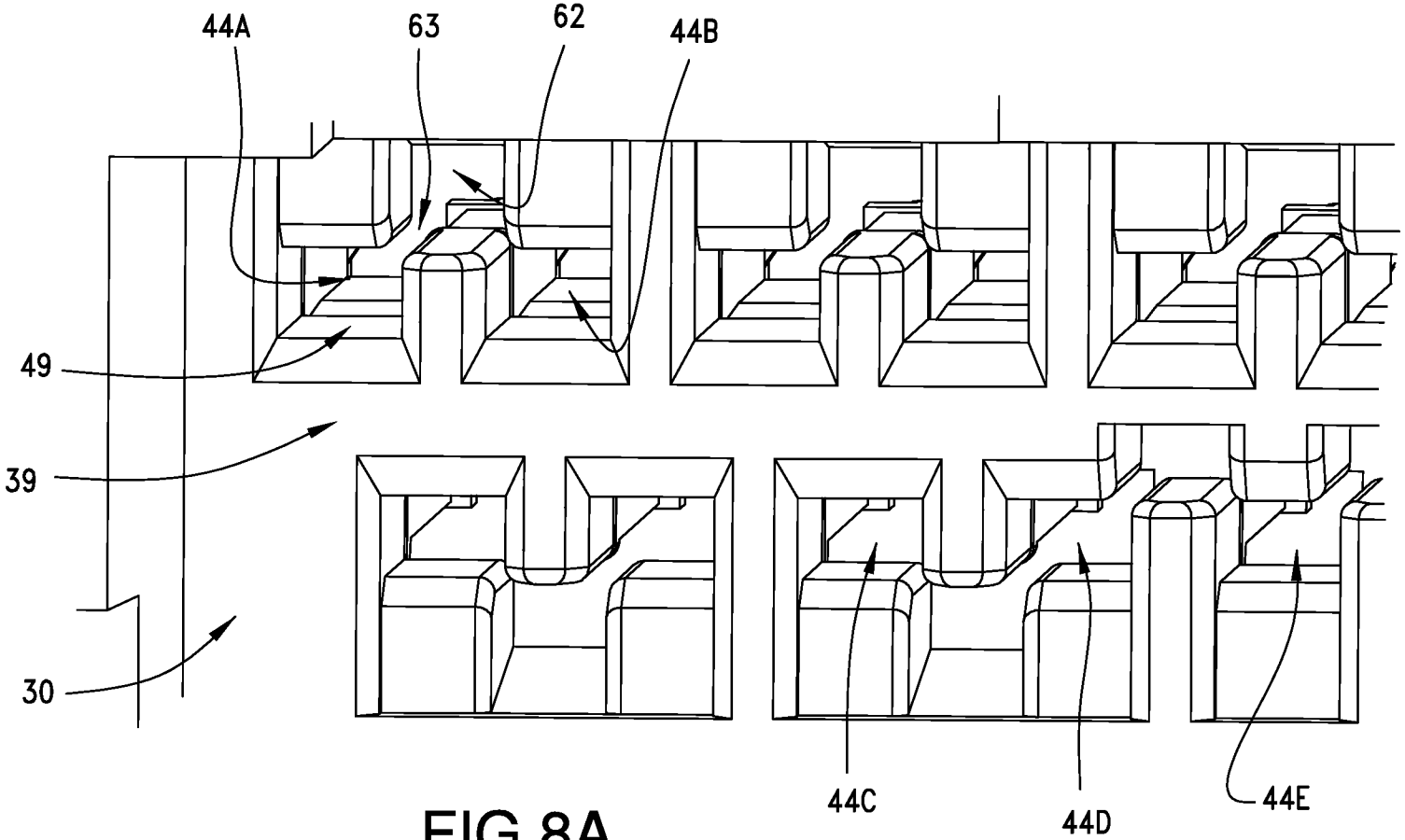
FIG. 8A illustrates an enlarged rear view of the housing depicted in FIG. 7 along the line 8A-8A.
Figure 9:
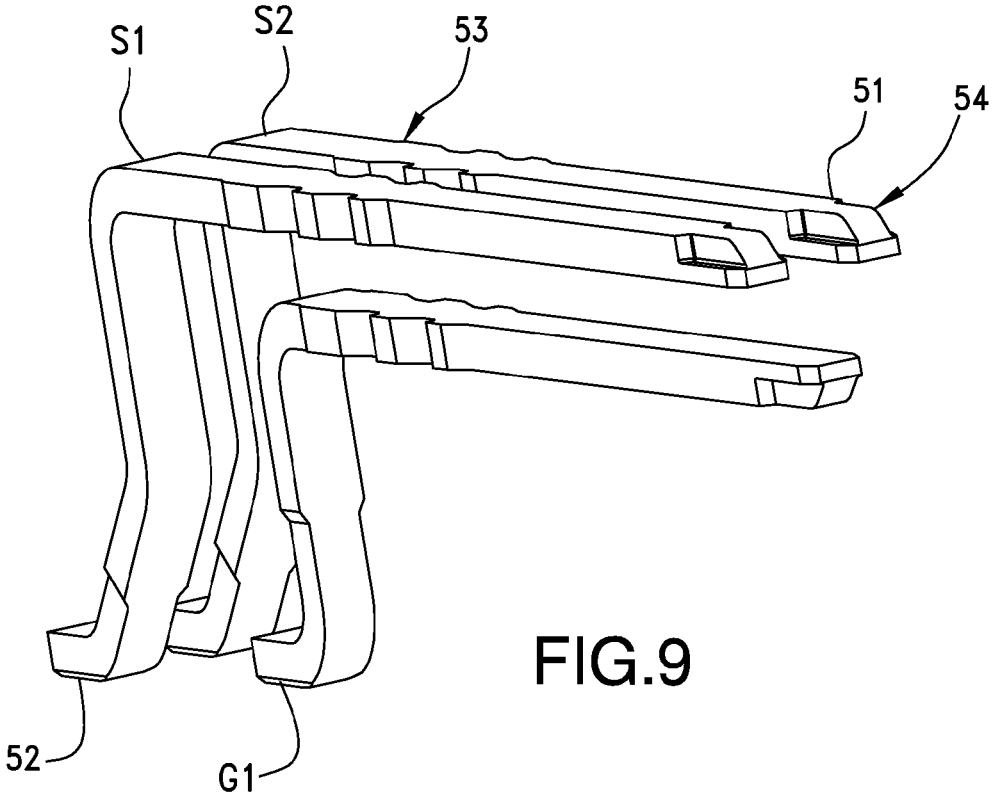
FIG. 9 illustrate a perspective view of an embodiment of three terminals in a triangular configuration.
Figure 10:
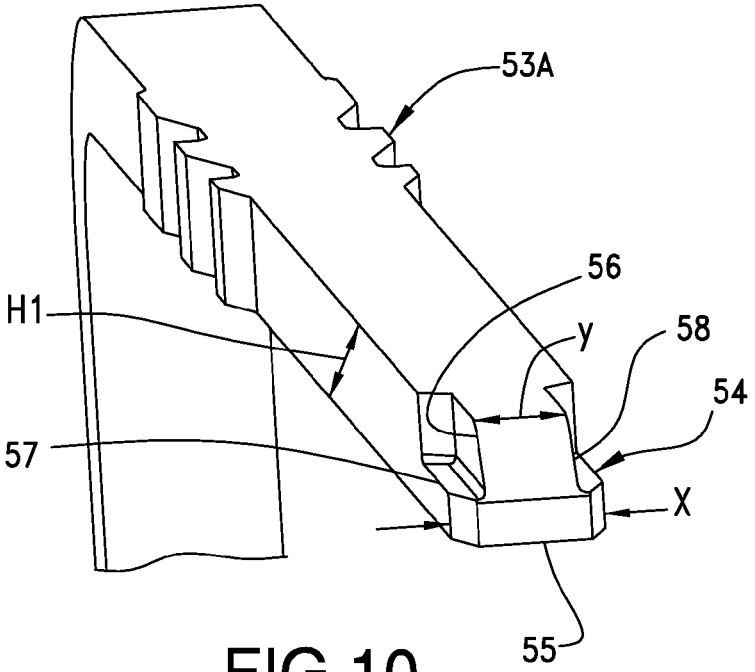
FIG. 10 illustrates a perspective view of an embodiment of a mating portion of a terminal.
Figure 11:
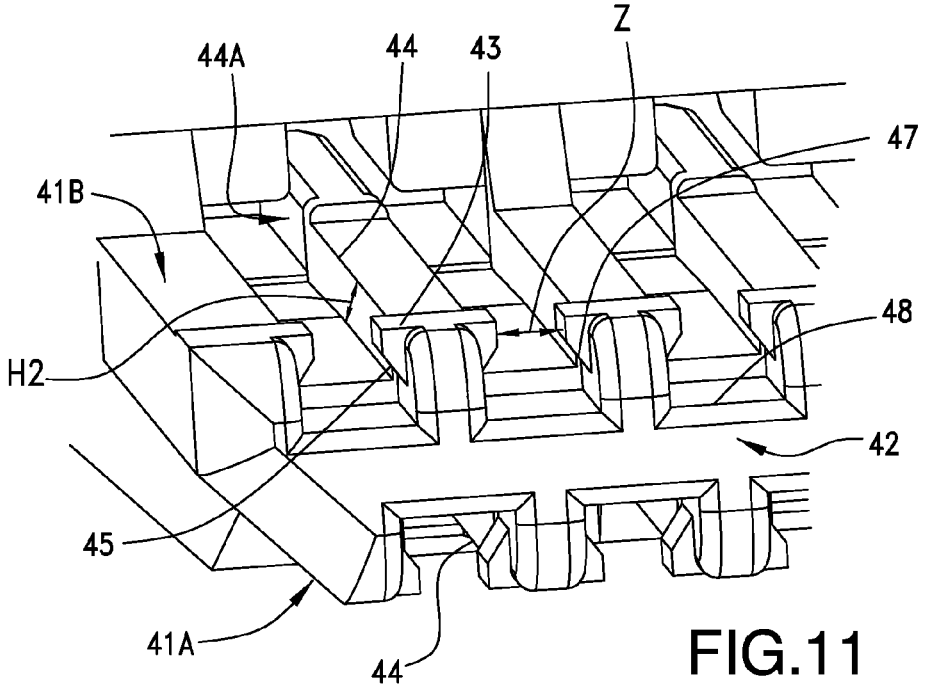
FIG. 11 illustrates a perspective view of an embodiment of a mating end of a tongue.
Figure 12:
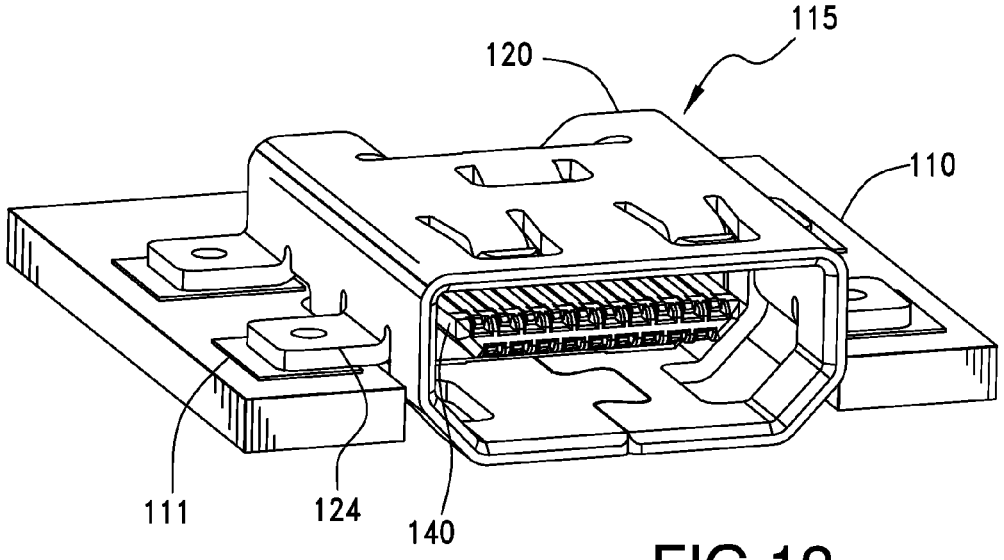
FIG. 12 illustrates a perspective view of an embodiment of a low-profile board mounted connector.
Figure 13:
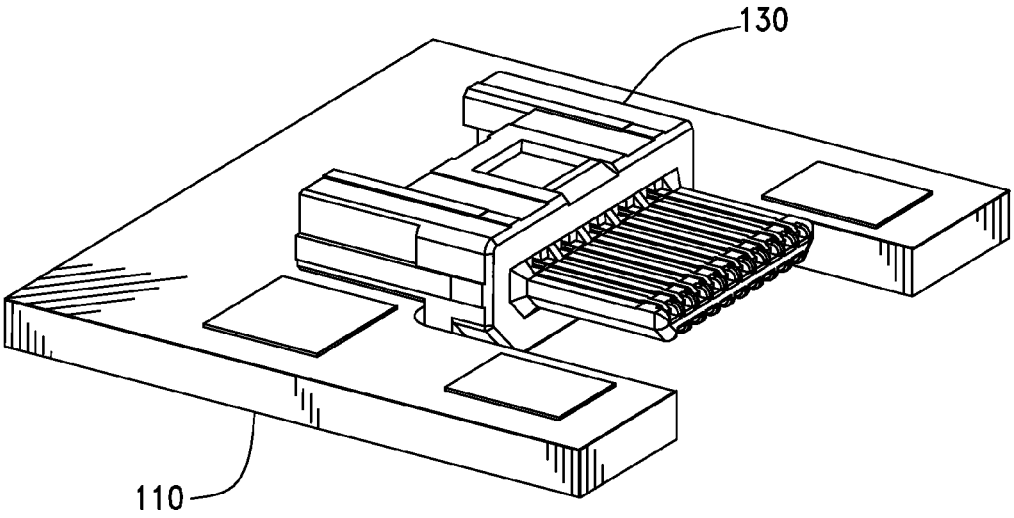
FIG. 13 illustrates a perspective view of the connector depicted in FIG. 12 with the shield removed for purposes of clarity.
Figure 14:
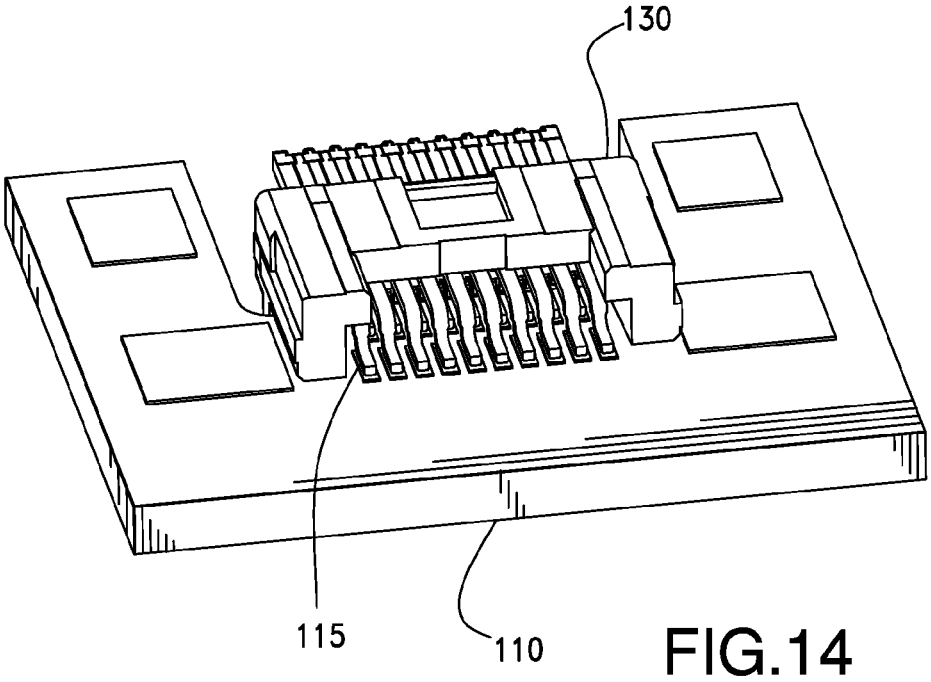
FIG. 14 illustrates another perspective view of the connector depicted in FIG. 13.
Figure 15:
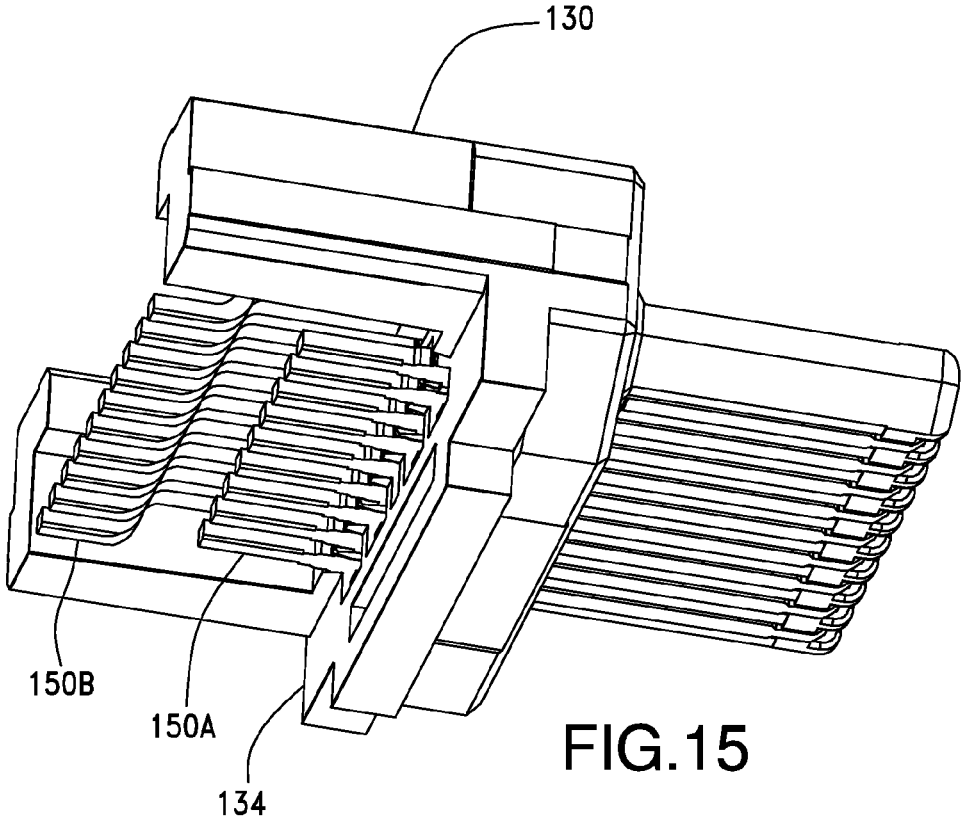
FIG. 15 illustrates a perspective view of the connector depicted in FIG. 14 with the circuit board removed for purposes of clarity.
Figure 16:
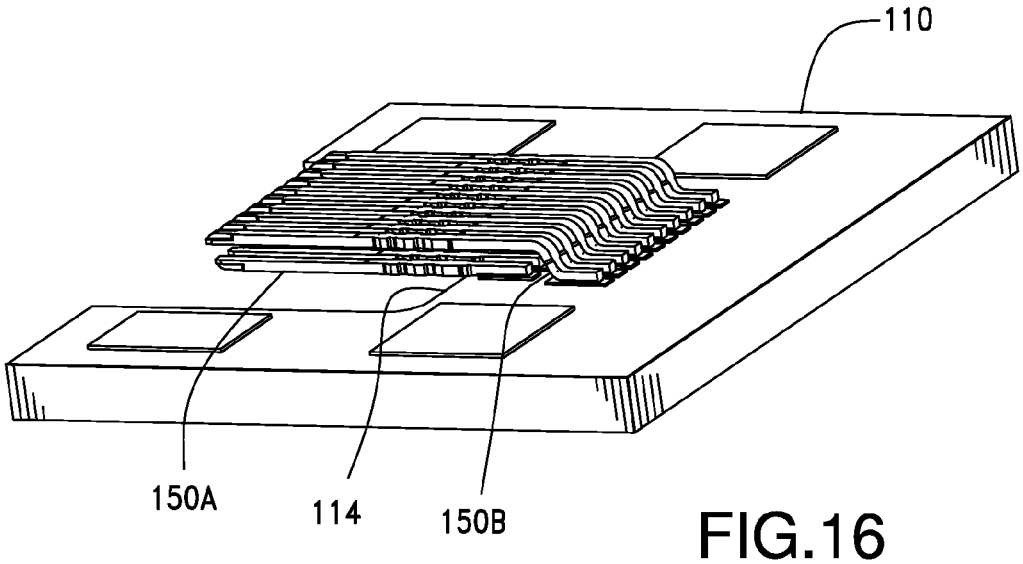
FIG. 16 illustrates a perspective view of an embodiment of how terminals can be arranged with respect to a circuit board.
Figure 17:
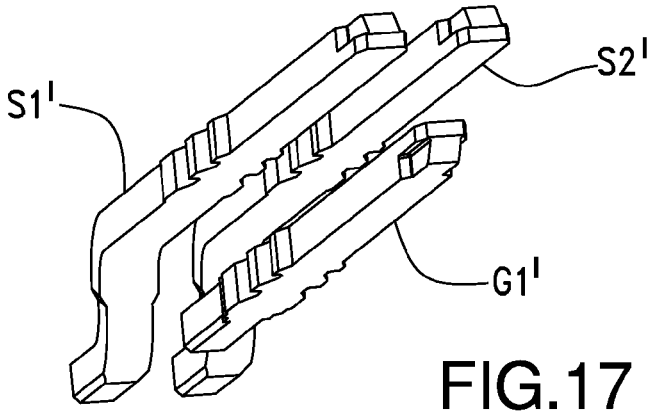
FIG. 17 illustrates a perspective view of an embodiment of a triangular arrangement of terminals based on the terminals depicted in FIG. 16.
Figure 18:
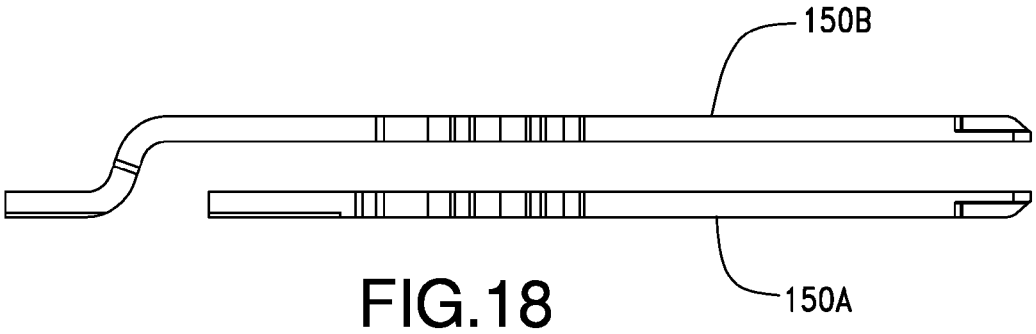
FIG. 18 illustrates a side view of the two rows of terminals depicted in FIG. 16.

As can be appreciated from FIG. 8A, which is rear view of the housing 30, the housing 30 includes a back wall 39 in which the grooves 44 that receive the terminals channel extend through. In an embodiment, groove 44A is in communication with groove 44B via a notch 62 and a channel 63. The channel 63 and notch 62 allow an insert tool to span both groove 44A and groove 44B, thus allowing the insert tool to be made stronger. The channel 63 and notch 62 can also help provide air for cooling the terminals. As depicted, the notch extends in a manner so that that U-shaped three-prong insert tool can be used. It should be noted that while the notch 62 is preferred as it allows the corresponding insert tool to be made stronger, in an alternative embodiment the housing could just have a channel that brings adjacent grooves into communication.

FIGS. 12-18 illustrate another embodiment of a connector 115 that includes a shield 120 that supports a housing 130 and is mounted to a circuit board 110 via tabs 124 that can be bounded to pads 111. The connector 115 has the advantage of being configured so that is a lower profile connector and in an embodiment can be less than 2 mm above the circuit board while still providing full compatibility with a HDMI or DisplayPort standard, which can be particularly advantageous for designs were an extremely low profile connector is desired.

The embodiment depicted in FIGS. 12-18 includes a tongue 140 that can be substantially similar to the embodiment depicted in FIGS. 2-11. For example, the configuration of the groove and mating end of the terminal 150 can be substantially the same in both embodiments. It should be noted, however, that while a second row of terminals 150B is similar to the rows of terminals in the configuration depicted in FIGS. 2-11, a first row 150A of terminals is somewhat different because the terminals are flat (as can be appreciated from FIGS. 17-18). This provides an easier to form terminal that can readily maintain a desirable triangular relationship between two terminals in one row and one terminal in the other row. It should be noted that portions of the connector 115 extend below the circuit board 110, thus further lowering the connector 115 with respect to the circuit board 110 would just move the part of the connector from one side to the other and the lower terminals would need to be bent for a conventional SMT mounting on the same surface. Thus, when it is desirable to avoid a bend in the first row of terminals 150A then further lower is not possible with a conventional SMT mounting to the circuit board 110.

It should be noted that to provide strain relief for the housing 130, a flange 134 can extend down and be engaged by the shield 120 so that force exerted on the tongue and housing is transferred to the shield 120.

Figure 19:
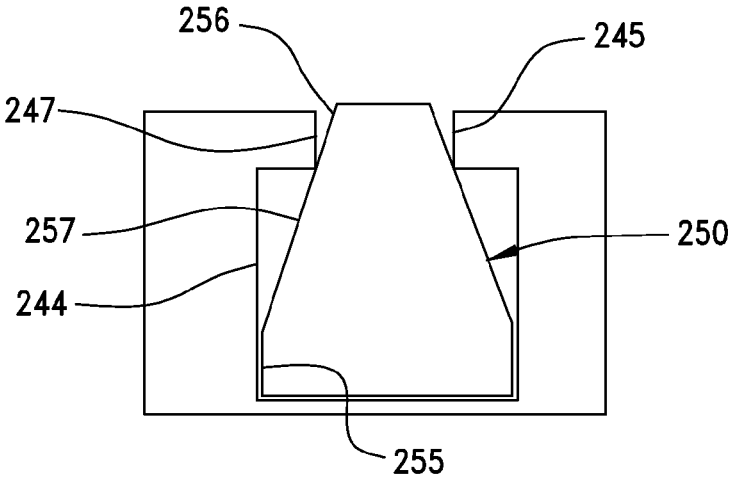
FIG. 19 illustrates a cross-section of an alternative embodiment of a terminal and groove configuration.

As can be appreciated from FIG. 19, while a terminal can have a step and the groove can have a ramped surface to engage the step of the terminal, in an alternative embodiment a groove 244 can include retention feature 245 which is a step and a terminal 250 can include a base 255 that has a ramped transition 257 between the base 255 and the leg 256. In both circumstances, the combination of the ramp and the step allows for reliable insertion of the terminal into the groove while helping to ensure the terminal is properly retained in the groove. As can be appreciated, the groove and the terminal could also both include either a step surface or a ramped surface at the point of interface between the two but such a configuration would tend to require a slightly higher degree of precision when inserting the terminal into the groove. In general, it is expected that forming the terminal with a stepped transition (as steps tend to be simpler to form) and forming a ramped surface in the groove (as depicted in the embodiments depicted in FIGS. 2-18) will provide a desirable configuration.

The present invention has been described in terms of preferred and exemplary embodiments thereof. Numerous other embodiments, modifications and variations within the scope and spirit of the appended claims will occur to persons of ordinary skill in the art from a review of this disclosure.

We claim:

1. A connector, comprising:

a shield having a conductive property and forming an receptacle portion;

a housing at least partially supported by the shield;

a tongue positioned in the receptacle portion and extending from the housing and having a first side and a second side and a mating end, the tongue includes a plurality of grooves on the first and second side, each groove extending to the mating end such that the groove is open all the way to the mating end and further including a retention feature approximate the mating end, the retention feature causing the groove to neck down to a first width at a top of the groove; and a plurality of terminals positioned in the plurality of grooves, the plurality of terminals each including a mating portion, a mounting portion and a body portion extending therebetween, the mating portion including a first tip portion, a second tip portion and an end, the first tip portion facing the respective side of the tongue and having a second width, the second tip portion being on an opposing side of the terminal and having a third width less than the second width, the second width being greater than the first width, wherein the end of each of the plurality of terminals is not positioned under a lip of plastic so that at least a portion of each of the plurality of terminals is exposed in the corresponding groove from the body to the end of the mating portion.

2. The connector of claim 1, wherein the plurality of terminals have a first height and the groove has a second height that is less than the first height.

3. The connector of claim 2, wherein the plurality of terminals each have an inclined nose portion.

4. The connector of claim 1, wherein the grooves on the first side are offset from the grooves on the second side.

5. The connector of claim 1, wherein the retention feature comprises one of two ramped surfaces on opposing sides of the groove and two stepped edges on opposing sides of the groove.

6. The connector of claim 5, wherein the first and second tip portion form a T shape with the base of the T positioned between the retention feature and a bottom of the groove.

7. The connector of claim 1, wherein the groove includes a recess aligned with the retention feature, wherein the mating portion is deflected partially into the recess by the retention feature.

8. The connector of claim 1, wherein the housing includes a back wall in which the grooves extend through, at least a first and second groove in communication with each other via a channel.

9. The connector of claim 8, wherein the adjacent grooves are in communication via a notch.

10. The connector of claim 8, wherein at one of the rows of grooves has at least three adjacent grooves that are in communication with each other via channels.

11. The connector of claim 1, wherein the terminals are arranged on a 0.4 mm pitch.

12. A connector, comprising:

a housing with a tongue extending to a mating end, the tongue having a first and second opposing sides and a plurality of grooves extending toward the mating end, the grooves each having a retention profile adjacent an end of the groove, the retention profile having a width that increases from a first width at a top portion of the groove to a second width at a lower portion of the groove; and a plurality of terminals, each terminal positioned in one of the plurality of grooves and having a mating portion, a mounting portion and a body portion extending therebetween, the mating portion having an and end and an inverted T-shaped terminal profile configured to engage the retention profile, wherein the engagement of the terminal profile with the retention profile secures the mating end in the groove while leaving an upper surface of each terminal exposed from the body portion to the end.

13. The connector of claim 12, further comprising a shield that at least partially encloses the housing, the shield configured to support the housing on a circuit board and provide an enclosure that extends around the tongue.

14. The connector of claim 12, wherein the plurality of grooves are arranged in a pattern that alternates between the first and second side of the tongue, wherein the mating portions of the terminals positioned in the grooves form alternating orientated triangles that alternate between one terminal on the first side and two terminals on the second side and two terminals on the first side and one terminal on the second side, and the corresponding triangular orientation between the terminals is maintained through the body and into the mounting portion.

15. The connector of claim 14, wherein the mounting portion is configured to be mounted via surface mount technology and the mounting portions are aligned in two rows.

16. The connector of claim 12, wherein the plurality of terminals each have an inclined nose portion, whereby a mating terminal can be translated into position without first engaging the tongue.

17. The connector of claim 16, wherein the plurality of terminals each do not extend to the end of the corresponding groove.

18. The connector of claim 16, wherein the plurality of terminals each extends above the corresponding side of the groove.

19. The connector of claim 12, wherein the terminals are on a 0.4 mm pitch.

20. A connector, comprising:

a housing with a tongue extending to a mating end, the tongue having a first side and second side opposing the first side and a plurality of grooves extending toward the mating end on both the first and second side, the grooves each having a retention profile adjacent an end of the groove, the retention profile having a width that increases from a first width at a top portion of the groove to a second width at a lower portion of the groove; and a plurality of terminals, each terminal positioned in one of the plurality of grooves and having a mating portion, a mounting portion and a body portion extending therebetween, the mating portion having an end and a profile configured to engage the retention profile, wherein the mating portion of each of the plurality of terminals has a top surface that includes a ramped surface that extends to the end, wherein at least a portion of the top surface is exposed along the entire mating portion up to the end.

* * * * *